US006315602B1

(12) United States Patent
Miura et al.

(10) Patent No.: US 6,315,602 B1
(45) Date of Patent: Nov. 13, 2001

(54) RETAINER FOR ELECTRICAL CONNECTOR AND ELECTRICAL CONNECTOR

(75) Inventors: Kazuto Miura; Hiroshi Yamane; Hiromasa Yokoyama, all of Kanagawa (JP)

(73) Assignee: J.S.T. Mfg. Co., LTD, Osaka (JP)

( * ) Notice: Subject to any disclaimer, the term of this patent is extended or adjusted under 35 U.S.C. 154(b) by 0 days.

(21) Appl. No.: 09/630,367

(22) Filed: Aug. 1, 2000

(30) Foreign Application Priority Data

Aug. 3, 1999 (JP) ..... 11-220283

(51) Int. Cl.[7] ..... H01R 12/24
(52) U.S. Cl. ..... 439/495
(58) Field of Search ..... 439/495, 492, 439/606, 357, 358, 405

(56) References Cited

U.S. PATENT DOCUMENTS 4,431,248 * 2/1984 Huntley et al. ..... 439/405
4,621,885 * 11/1986 Szczesny et al. ..... 439/357
5,021,002 * 6/1991 Noschese ..... 439/357
5,882,223 * 3/1999 Igarashi ..... 439/495
6,116,941 * 9/2000 Kuo ..... 439/357
6,155,864 * 12/2000 Yoshiura ..... 439/357

FOREIGN PATENT DOCUMENTS

3248522 * 7/1984 (DE) ..... 439/495
UM6-82783 11/1994 (JP) .
7-106028 4/1995 (JP) .
9-283236 10/1997 (JP) .

* cited by examiner

*Primary Examiner*—Tho D. Ta
(74) *Attorney, Agent, or Firm*—Rader, Fishman & Grauer, PLLC

(57) ABSTRACT

A retainer for an electrical connector presses an end of a flat cable into contact with a plurality of contacts in an insertion space, the flat cable inserted in the insertion space of a housing of the electrical connector. The retainer includes a main body formed of a synthetic resin, a pair of connection arms made of metal and fixed to the main body. The connection arms are connected to the housing as allowed to slide in a predetermined direction.

17 Claims, 8 Drawing Sheets

RETAINER FOR ELECTRICAL CONNECTOR AND ELECTRICAL CONNECTOR

CROSS REFERENCE TO RELATED APPLICATION

This application claims the benefit under 35 U.S.C. §119 of Japanese Patent Application No.11-220283, the abstract of disclosure of which is incorporated herein by reference.

BACKGROUND OF THE INVENTION

1. Field of the Invention

The present invention relates to a retainer, called slider, for use in an electrical connector for connecting a flexible board such as called FPC (Flexible Printed Circuit) board, or a flexible flat cable such as FFC (Flexible Flat Cable) to a circuit board, as well as to an electrical connector including the same.

2. Description of Related Arts

As a slide-type retainer (hereinafter, simply referred to as "slider") used in the connectors of this type, various types have been proposed which are formed of a synthetic resin material as a whole and include a transversely extended main body having an insertable projection and a pair of connection arms extended therefrom (see, for example, Japanese Utility Model Laid-Open Gazette No. 6-82783 (1994), Japanese Patent Laid-Open Gazette Nos. 7-106028 (1995) and 9-283236(1997). Along with an FPC board (Flexible Printed Circuit board), the insertable projection is inserted in an insertion space of a synthetic-resin housing retaining a group of contacts, thereby pressing the FPC board into contact with the contact group. On the other hand, the pair of connection arms serve to interconnect the housing and the retainer, as extended from transversely opposite ends of the main body along lateral side surfaces of the housing in a manner to sandwich the insertable projection therebetween.

The recent demand for a thin, compact connector (of a so-called thin design) dictates the need to provide a thin, compact retainer.

However, in a case where the thin, compact retainer is integrally formed of a synthetic resin material in one molding step, the connection arms, in particular, are reduced in strength, becoming more prone to deform or fracture.

Additionally, the connection arms are exposed to the lateral sides of the housing and hence subject to external forces. This results in a greater possibility of fracture.

SUMMARY OF THE INVENTION

The invention contemplates a solution to the above problem and has an object to provide a retainer for electrical connector which is small in size but great in strength thereby to allow the connector to realize a layout having the connection arms inserted into the housing which need not be upsized.

According to a preferred mode of the invention for achieving the above object, a retainer for electrical connector for establishing pressure contact between an end of a flat cable inserted in an insertion space of a housing of the connector and a plurality of contacts in the insertion space comprises a main body formed of a synthetic resin, and a pair of connection arms made of metal and fixed to the main body, wherein the connection arms are connected to the housing as allowed to slide in a predetermined direction.

The connection arms are formed of metal so as to be reduced in thickness and size as well as to ensure the strength. Because of the thin, small connection arms, a layout with the connection arms unexposed to the lateral sides of the housing may be embodied in the connector which need not be upsized.

Preferably, the main body includes an elongate body section, and an insertable projection extended from the body section to be inserted in the insertion space, whereas the connection arms each include a buried portion buried in the body section during the molding of the main body, and a projecting portion projecting from the body section along the above predetermined sliding direction. In this case, the connection arms are inserted in the main body while it is being molded so as to be rigidly combined with the synthetic-resin main body.

Further preferably, the housing includes slide grooves for slidably receiving the respective projecting portions of the connection arms, and respective pairs of side walls corresponding to the respective slide grooves, the respective pairs of side walls preventing the corresponding projecting portions inserted in the slide grooves from exposing themselves to the lateral sides of the housing.

This arrangement allows each connection arm to be guided on its opposite sides, thus ensuring the stable guiding of each connection arm. As a result, the connection arm is prevented from disengaging from the housing or assuming a diagonal position. Additionally, the connection arms are free from unwanted external forces, thus being less prone to fracture.

BRIEF DESCRIPTION OF THE DRAWINGS

FIG. 9A is a sectional view showing the connector with the connection arm inclined in a slide groove, whereas

DETAILED DESCRIPTION OF THE PREFERRED EMBODIMENTS

Preferred embodiments of the invention will be described with reference to the accompanying drawings.

Figure 1:
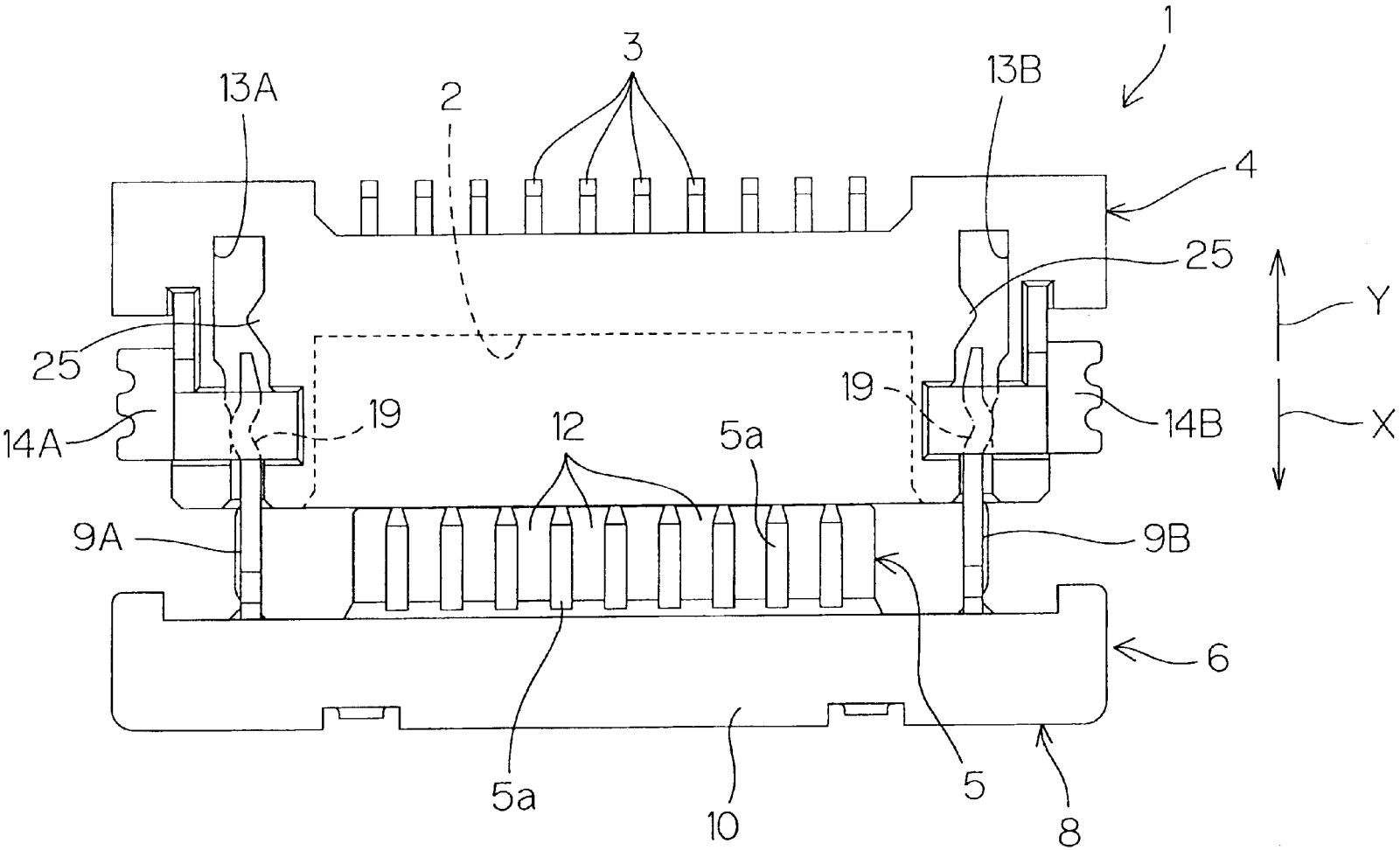
FIG. 1 is a plan view showing an electrical connector according to one embodiment of the invention with a slide-type retainer (hereinafter, referred to as "slider") drawn out.
Figure 2:
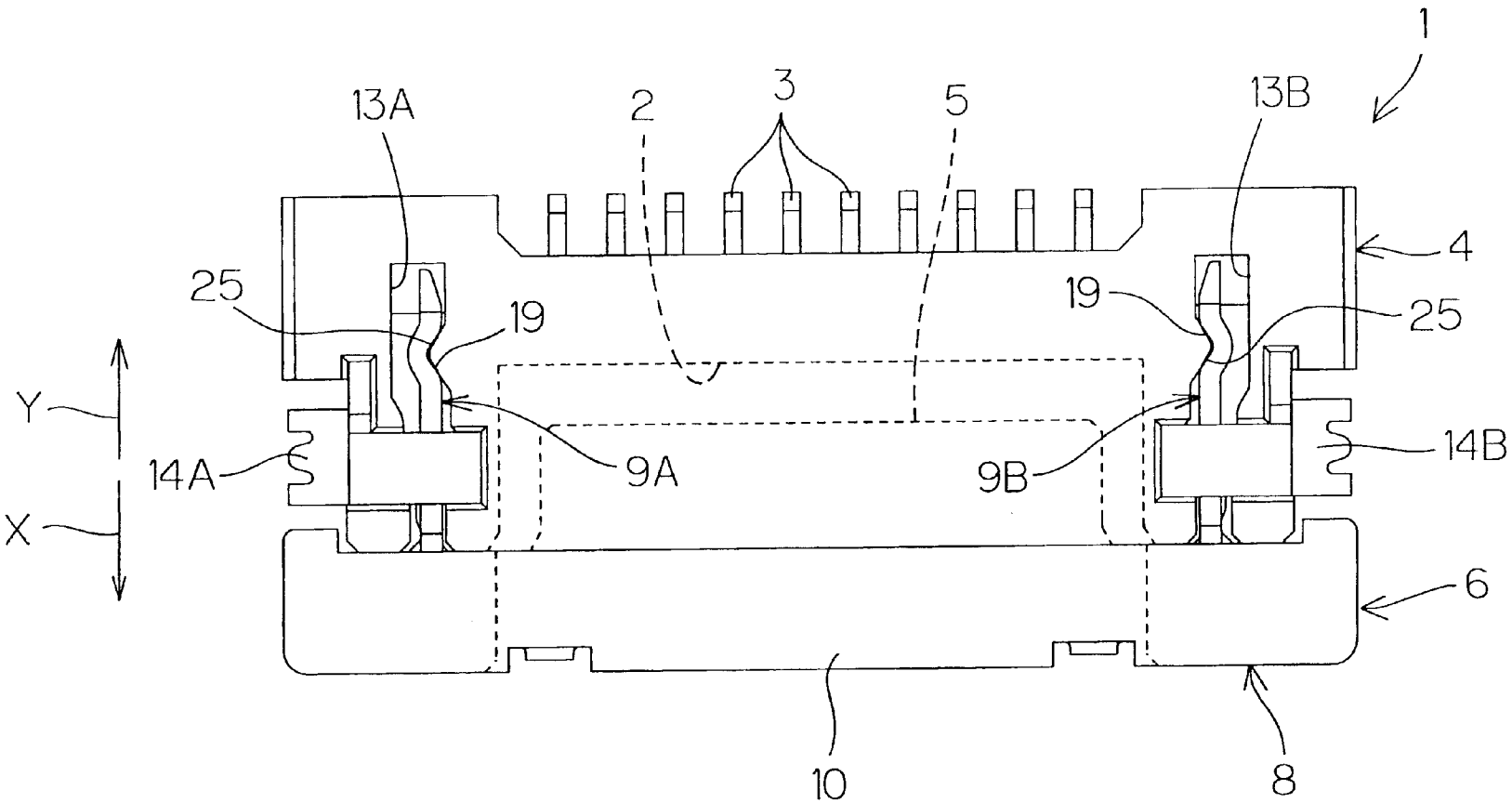
FIG. 2 is a plan view showing the connector with the slider inserted.
Figure 3B:
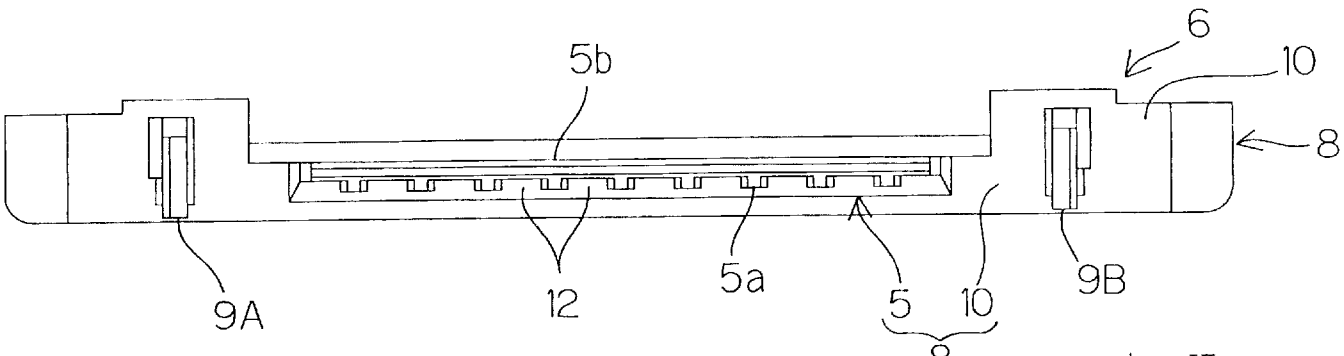
FIGS. 3A and 3B are a plan view and rear view of the slider.

Referring to FIGS. 1 and 2, a connector 1 according to one embodiment hereof includes a housing 4 retaining a plurality of contacts 3 transversely arranged in its insertion space 2 opening in a forward direction X, and a slider 6 having an insertable projection 5 to be inserted in or removed from the insertion space 2 of the housing 4. The insertable projection 5 is inserted into the insertion space 2 in a predetermined insertion direction (equivalent to a rearward direction Y) together with an FPC 7 as the flat cable (see FIGS. 7 and 9B). At the deepest position in the insertion direction Y, the insertable projection presses the FPC 7 into contact with the plural contacts 3 by means of its lower surface 5*b,* shown in FIGS. 3B, 5 and 7, serving as a pressing portion.

The slider 6 includes a main body 8 formed of a synthetic resin, and a pair of connection arms 9A, 9B, made of metal, which are mirror images of each other. The connection arms 9A, 9B are independent from each other and partially embedded in the main body 8 by insert molding. The main body 8 includes an elongate body section 10 extended transversely, and the insertable projection 5 extended from the body section 10. The insertable projection 5 is formed with receiving grooves 12 in its upper surface 5*a,* which individually correspond to fixing pieces 11 (FIG. 7) of fork-shaped portions of the contacts 3 (see FIGS. 1, 3A and 3B).

Turning to FIGS. 1 and 2, the housing 4 includes a pair of symmetrical slide grooves 13A, 13B opening in the forward direction X and an upward direction W (FIG. 4), the grooves located laterally opposite places with respect to the insertion space 2. As shown in FIGS. 1 and 2, the connection arms 9A, 9B of the slider 6 are adapted to slide in the forward direction X and the rearward direction Y (the directions to remove and insert the insertable projection 5) as received by the corresponding slide grooves 13A, 13B. The connection arms are also prevented from deviating from the slide grooves 13A, 13B by corresponding reinforcement tabs 14A, 14B made of metal. The reinforcement tabs 14A, 14B are symmetrically shaped. After the connection arms 9A, 9B are inserted in the slide grooves 13A, 13B, the reinforcement tabs are press-inserted from above to be fixed to given places of the housing 4 in a manner to span the respective slide grooves 13A, 13B.

As seen in FIG. 1, the connection arms 9A, 9B each include a lock section 19. As shown in FIG. 2, the lock sections 19 come into engagement with corresponding engageable extensions 25 disposed in the slide grooves 13A, 13B, thereby locking the slider 6 to the housing 4.

Figure 4:
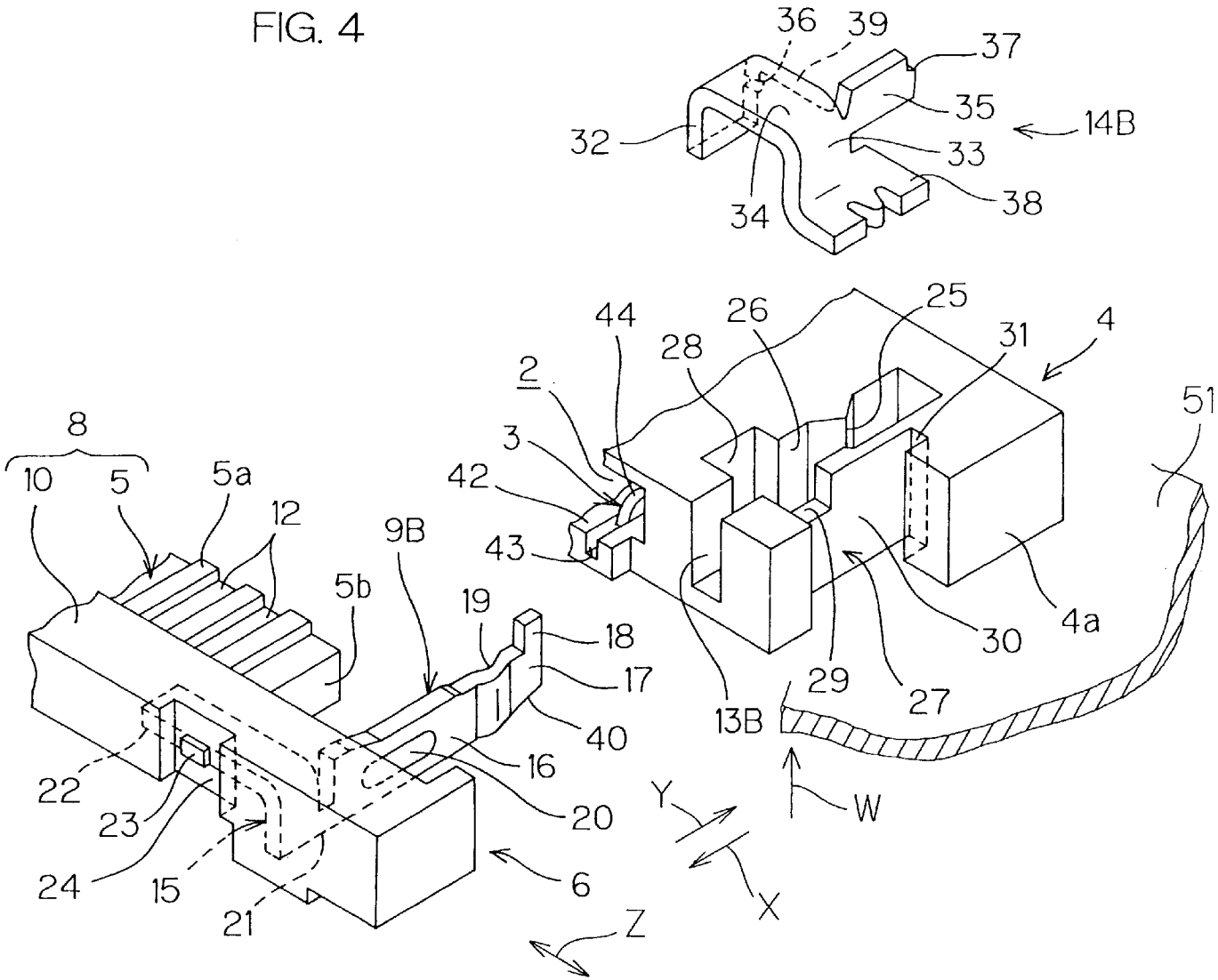
FIG. 4 is an exploded perspective view showing the slider, a housing and a reinforcement tab.
Figure 7:
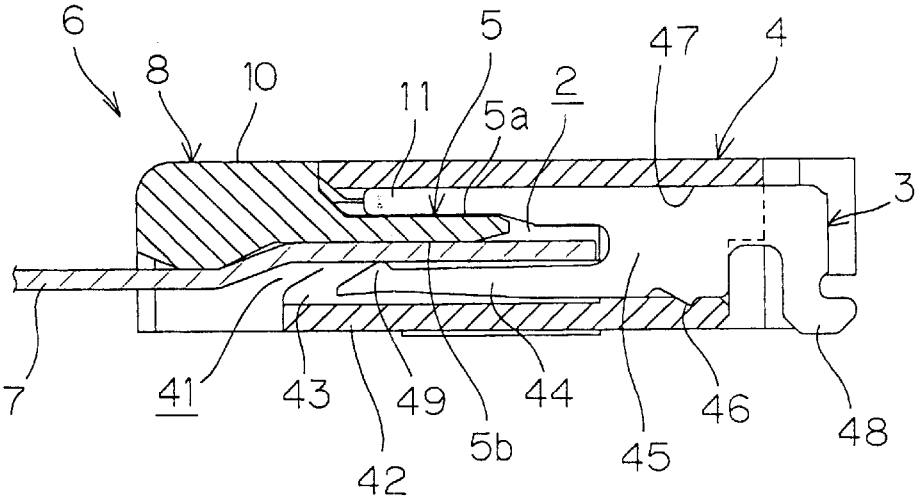
FIG. 7 is a sectional view showing the connector with the slider and an FPC inserted therein.
Figure 9A:
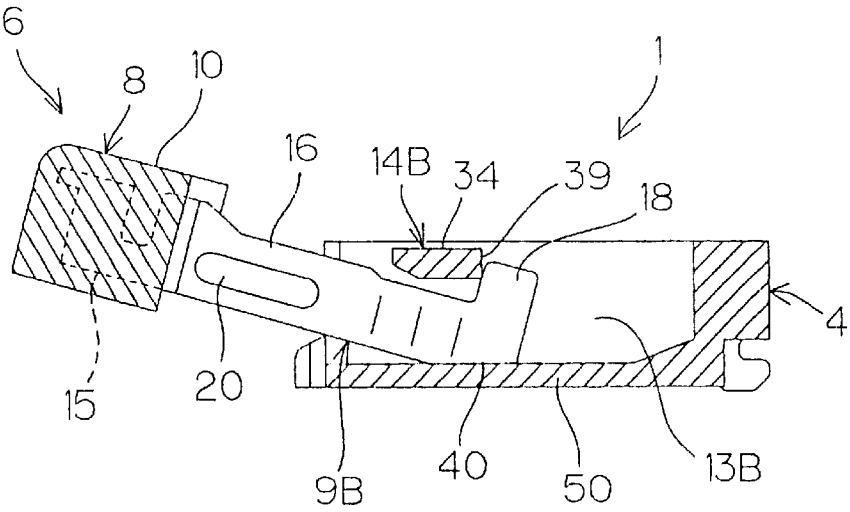
Figure 9B:
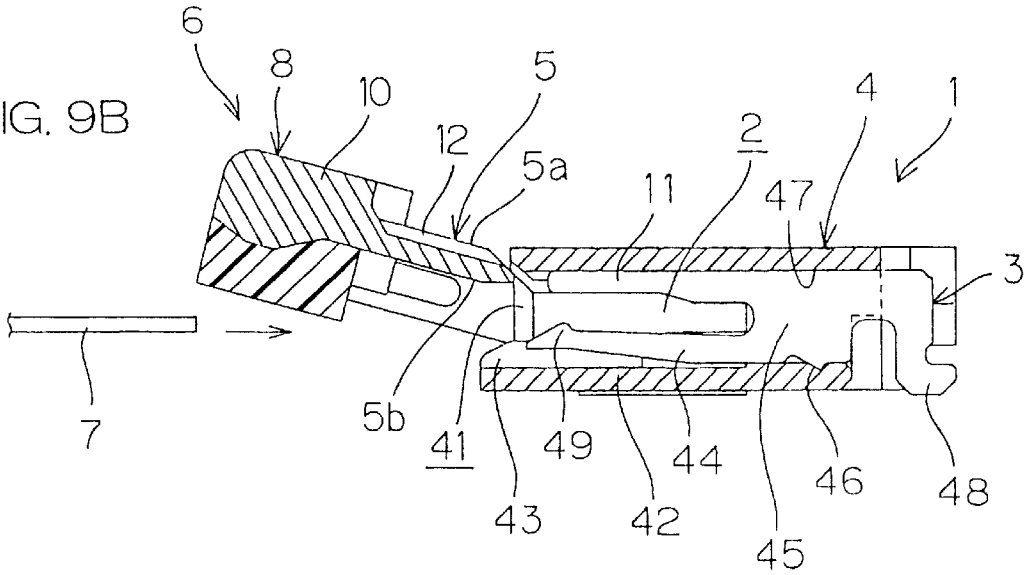
FIG. 9B is a sectional view showing the connector with an insertable projection inclined in an insertion space in association with the state of FIG. 9A.

Referring to FIG. 4 and FIGS. 7 and 9B showing the connector in section, the contact 3 includes a resilient piece 44 inserted in a receiving groove 43 formed in a top surface of a lower plate 42 of the housing 4, and the fixing piece 11 disposed above the resilient piece 44 to form the fork shape jointly with the resilient piece 44. The fixing piece 11 and the resilient piece 44 have their rear end portions interconnected by a main body 45. The main body 45 includes a locking projection 46 wedgingly engaging the lower plate 42. The main body 45 is press-inserted, from rear, into a fixing hole 47 of the housing 4 to be fixed therein. The main body 45 also has a substantially L-shaped lead portion 48 extended from an upper part of a rear end thereof. The lead portion 48 is soldered to a board surface on which the connector 1 is mounted. A chevron-shaped projection 49 ensures contact pressure by pressing against the inserted FPC 7. In FIGS. 7 and 9B, an unhatched area represents the section of the contact 3.

Figure 3A:
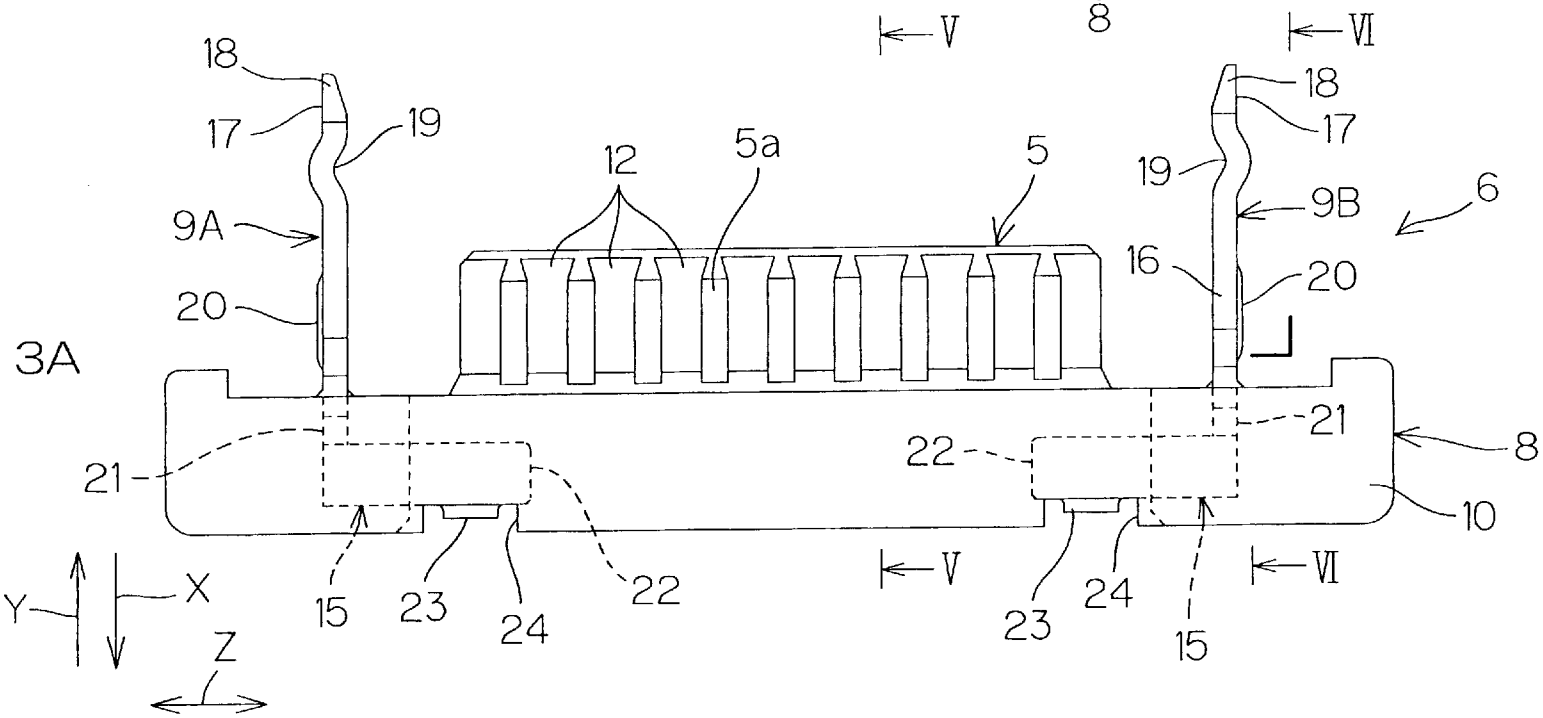
Figure 5:
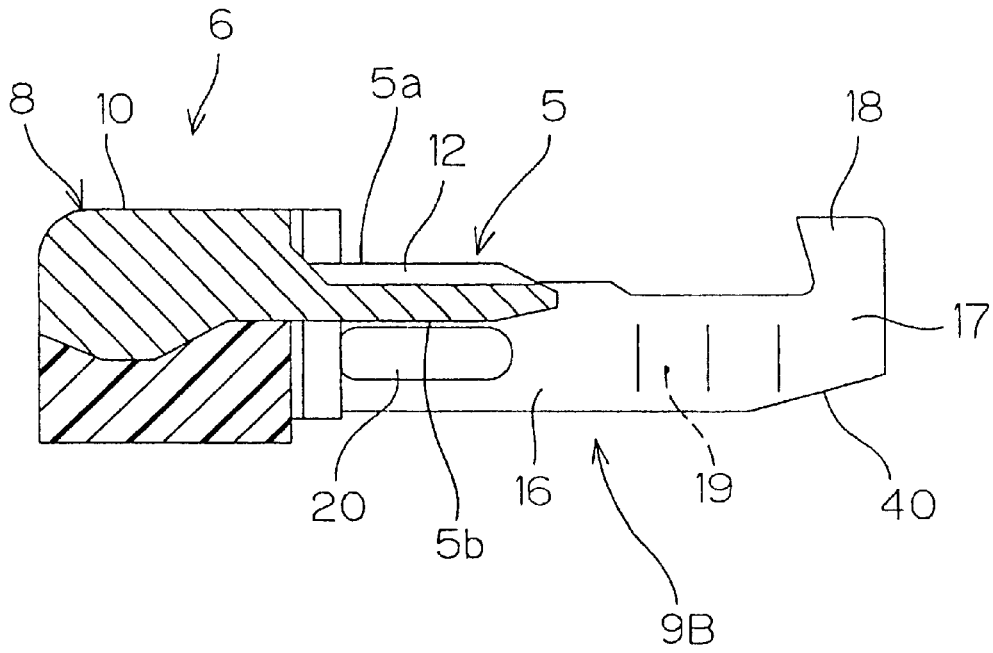
FIG. 5 is a sectional view taken on the line V—V in FIG. 3A.
Figure 6:
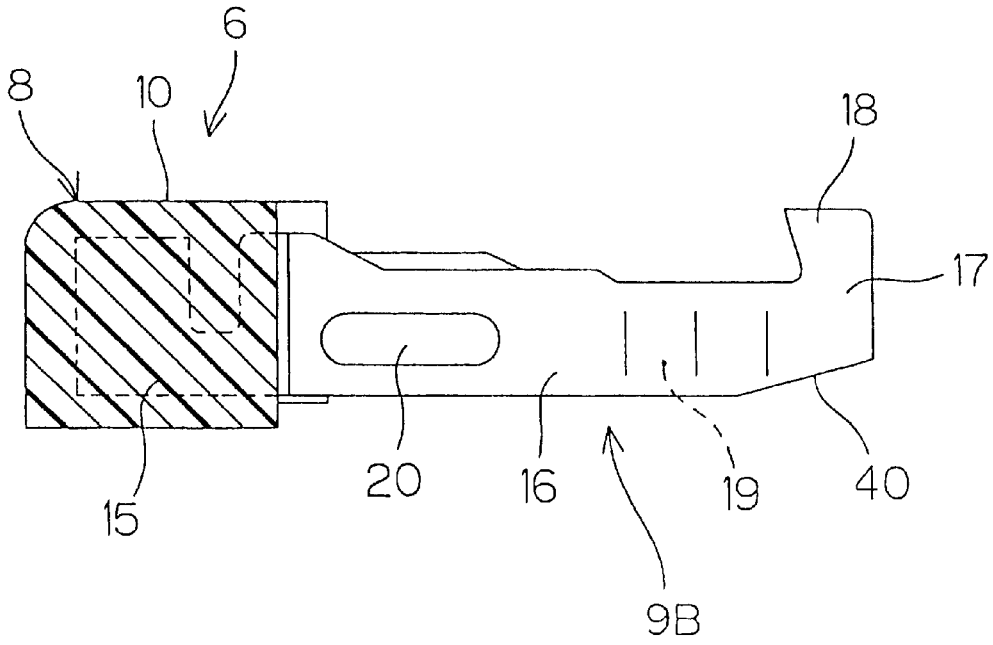
FIG. 6 is a sectional view taken on the line VI—VI in FIG. 3A.

Next, referring to FIG. 3A, an exploded perspective view of FIG. 4, FIG. 5 representing a sectional view taken on the line V—V in FIG. 3A and FIG. 6 representing a sectional view taken on the line VI—VI in FIG. 3A, the connection arms 9A, 9B of the slider 6 are each formed of a sheet metal into shape, including a buried portion 15 buried in the body section 10 of the main body 8, and a projecting portion 16 extended outwardly of the body section 10 in parallel relation with the insertable projection 5. The projecting portion 16 extends in the sliding direction Y.

The buried portion 15 includes a first section 21 coplanar with the projecting portion 16 and extended in the sliding direction X, and a second section 22 extended in a direction Z crossed by the sliding direction X as bent square to the first section 21. In forming a sheet metal, a substantially L-shaped piece of flat sheet metal in development is worked in such a manner that one part thereof (defining the second section 22) is bent square to the other part (defining the projecting portion 16 and the first section 21 of the buried portion 15). Since the buried portion 15 includes the bent section (the second section) extended in the direction Z crossed by the sliding direction X, the connection arm 9A, 9B is positively prevented from deviating from the body section 10.

The projecting portion 16 extends parallel to a side surface 5*b* of the insertable projection 5 (or parallel to a side surface 4*a* of the housing 4). A distal end 17 of the projecting portion 16 defines a hook portion 18 projected upward in a hook-like fashion. The distal end 17 of the projecting portion 16 is tapered at its lower side which thus defines a slope 40 inclined upward toward the end.

The connection arms 9A, 9B are formed with the lock sections 19 near the respective distal ends 17 thereof, the lock sections being comprised of a recess and disposed in face-to-face relation. With the insertable projection 5 so positioned as to press the FPC 7 into contact with the plural contacts 3, the lock sections 19 are in engagement with the engageable extensions 25 in the slide grooves 13A, 13B of the housing 4 thereby locking the slider 6 to the housing 4. In a process where the slider 6 drawn out to limit, as shown in FIG. 1, is inserted deepest in the housing, as shown in FIG. 2, the connection arms 9A, 9B are resiliently distended so as to allow the distal ends 17 of the projecting portions 16 to slide over the corresponding engageable extensions 25, thereby bringing their lock sections 19 into engagement with the engageable extensions 25, as shown in FIG. 2. Indicated at 20 is a bead portion comprised of a hollow projected rib for reinforcement of the projecting portion 16.

The first section 21 of each buried portion 15 is of a vertical plate continuous to the projecting portion 16, whereas the second section 22 is of a horizontal plate bent into square along a line corresponding to an upper edge of the first section 21 and extended toward the counterpart buried portion 15. The second section 22 includes a projection 23, which is exposed outside via a recess 24 formed in the body section 10. The projection 23 is used for retaining the connection arm 9A, 9B at place during molding so as to prevent the connection arm from being displaced in molding dies. That is, the connection arm 9A, 9B with high positional precisions may be obtained because the connection arm 9A, 9B is retained at both a part defining the projecting portion 16 and a part defining the projection 23 during the insert molding thereby ensuring the prevention of the displacement thereof.

Turning to FIG. 4, the slide groove 13B extends parallel with the side surface 4*a* of the housing 4. As mentioned supra, the slide groove opens in the forward direction X and the upward direction W for receiving the corresponding connection arm 9B from front. Out of opposite side walls 26, 27 of the slide groove 13B, the one 26 away from the side surface 4*a* is vertically formed with a first press-fit groove 28 at place closer to its front end, the groove 28 communicating with the slide groove 13B and press-fittedly receiving the reinforcement tab. The side wall 26 is further formed with the engageable extension 25 at place closer to its rear end. The first press-fit groove 28 opens upward. The engageable extension 25 is of a chevron shape in section and vertically extended.

On the other hand, the side wall 27 closer to the side surface 4*a* is formed with a relief groove 29 at its upper part, corresponding to the position of the first press-fit groove 28. The side wall 27 is further formed with a second press-fit groove 30 comprised of a through groove for press-fittedly receiving the reinforcement tab, the groove extended along an overall vertical length of an outer side of the side wall 27. A large part of the press-fit groove 30 opens to the side surface 4*a* of the housing 4 so that only a rear part 31 thereof is defined by opposite side walls.

The reinforcement tab 14B is formed of a sheet metal into a ladle-like shape in front elevation. Specifically, the reinforcement tab 14B includes a first and second press-fitted sections 32, 33 as fixed portions to be press-fitted in the first and second press-fit grooves 28, 30, and an interconnection section 34 interconnecting respective upper ends of the first and second press-fitted sections 32, 33. The press-fitted section 33 includes an extension 35 extended rearwardly. The first press-fitted section 32 is formed with a press-fit projection 36 at its rear end surface, whereas a press-fit projection 37 is formed at a rear end surface of the extension 35 of the second press-fitted section 33. Further, a leg 38 is horizontally extended from a lower end of the second press-fitted section 33, as bent square thereto. The leg 38 is soldered to a conductive area of a printed circuit board 51. The leg is shaped like comb teeth for increased solderability.

Figure 8:
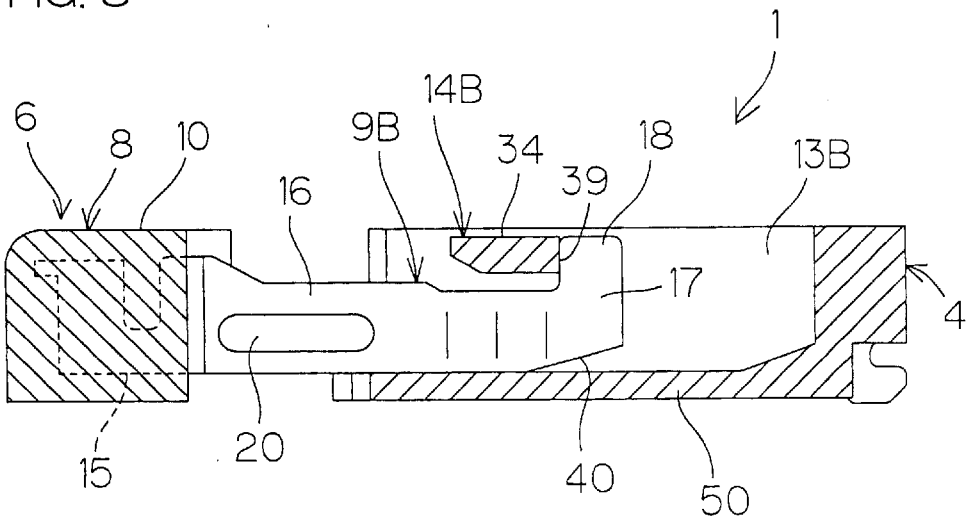
FIG. 8 is a sectional view showing the connector with the reinforcement tab preventing the deviation of the connection arm.

As shown in FIG. 8, a rear edge of the interconnection section 34 defines an anti-deviation engagement section 39 which engages the hook portion 18 of the connection arm 9B for preventing the connection arm 9B from displacing forward out of the slide groove 13B. The connection arm 9B is adapted to slide with a lower edge of the projecting portion 16 thereof guided by a lower plate 50 defining a bottom of the slide groove 13B, as shown in FIG. 8.

After the connection arm 9B is inserted, from front, into the slide groove 13B, the reinforcement tab 14B is mounted to the housing 4 in a manner that the first and second press-fitted sections 32, 33 are press-fitted in the first and second press-fit grooves 28, 30 of the housing 4, respectively. Thus, the reinforcement tab serves as the anti-deviation section for the connection arm 9B.

According to the embodiment, the connection arms 9A, 9B of the slider 6 are formed of metal so as to be reduced in thickness and size as well as to ensure sufficient strength. In addition, the connection arms 9A, 9B are rigidly connected to the main body 8 because they are inserted in a synthetic resin being molded to form the main body 8.

Besides, the connection arms 9A, 9B reduced in thickness and size permit a so-called inner-lock layout such as of the invention to be embodied in the connector 1 which need not be upsized. Specifically, the connection arms 9A, 9B are slidably inserted in the slide grooves 13A, 13B in parallel relation with the side surfaces 4*a* of the housing 4 so that the connection arms 9A, 9B are not exposed to the lateral sides of the housing 4 while operating in the housing 4 to lock the slider 6 to the housing.

In this case, the connection arms 9A, 9B each have its opposite sides guided for stable movement, thus prevented from going out of track or assuming a diagonal position. Additionally, the connection arms 9A, 9B are less likely to fracture because they are free from unwanted external forces.

The metallic connection arms 9A, 9B of high strength are employed for locking the slider 6 to the housing 4, thus ensuring the rigid lock.

As shown in FIG. 9A, the connection arm 9B(9A) can be inclined in a manner that the slope 40 at the lower side of the distal end 17 of the projecting portion 16 of the connection arm 9B(9A) is brought into intimate contact with the lower plate 50 of the slide groove 13B. Therefore, in the insertion space 2, a relatively large entrance to an introduction space 41 for the FPC 7 may be defined under the insertable projection 5, as shown in FIG. 9B. This facilitates the insertion of the FPC 7.

Figure 10:
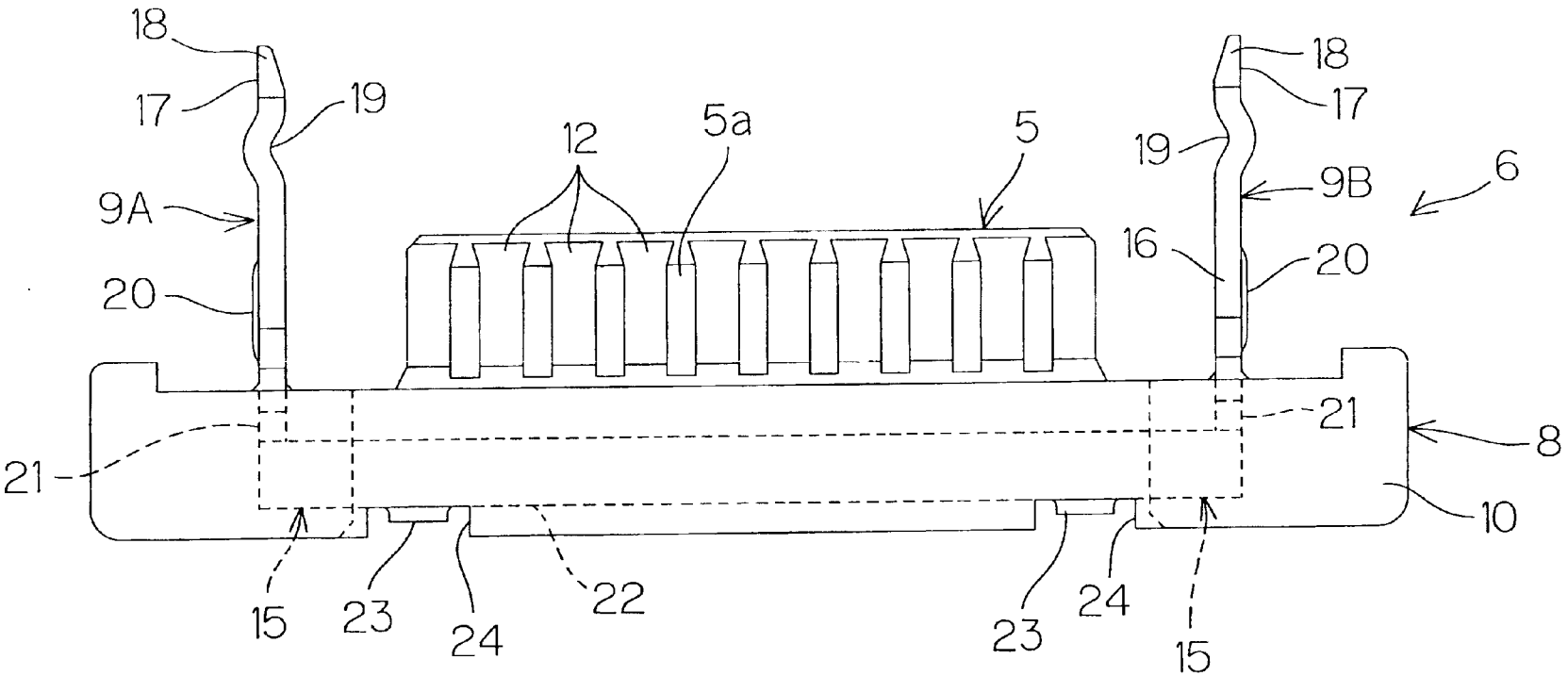
FIG. 10 is a plan view showing a slider according to another embodiment of the invention.

It is noted that the present invention is not limited to the foregoing embodiment. As shown in FIG. 10, for instance, the pair of connection arms 9A, 9B may be interconnected at the second sections 22 of their buried portions 15 so that the connection arms 9A, 9B may be formed in one piece.

In the foregoing embodiment, the connector is a so-called back-side contact type wherein a back side of the FPC 7 is pressed into contact with the contacts disposed thereunder. However, the invention is not limited to the above and the connector may be of a so-called top-side contact type wherein a top side of the FPC 7 is pressed into contact with the contacts disposed thereabove.

Although the foregoing embodiment is arranged such that the press-fit grooves open upwardly of the housing for press-fitting the reinforcement tabs from above, the invention is not limited to this arrangement. Alternatively, the press-fit grooves may open downwardly of the housing so that the reinforcement tabs are press-fitted from below of the housing and fixed in places. In this case, the slide grooves also open downwardly.

The invention is applicable to a so-called vertical type connector wherein the housing 4 is laid out on the circuit board in a manner that the insertion space 2 opens upward for vertical insertion or removal of the slider 6. Other various changes and modifications may be contemplated within the scope of the invention.

What is claimed is:

1. A retainer for an electrical connector for establishing pressure contact between an end of a flat cable inserted in an insertion space of a housing of the connector and a plurality of contacts in the insertion space comprising:

a main body formed of a synthetic resin and including an elongate body section and an insertable portion extended from the body section for insertion into the insertion space; and a pair of connection arms made of metal and fixed to the main body, and also connectable to the housing by being slidable along the housing in a predetermined direction, each connection arm including, a buried portion that is buried in the body section during molding of the main body, and a projecting portion projecting from the body section along a predetermined position, a distal end of each projecting portion having a slope that is inclined with respect to the predetermined direction, wherein the connection arms are slidably insertable into corresponding slide grooves of the housing in the predetermined direction, and slidable along the slide grooves for guiding the insertable projection in its insertion into or removal from the insertion space, and the connection arms are inclinable to bring the respective slopes thereof into abutment against bottoms of the corresponding slide grooves, thereby relatively expanding, in the insertion space, an entrance to an introduction space for the flat cable.

2. The retainer claimed in claim 1, wherein the buried portion of each connection arm includes a section extended in a direction crossed by the predetermined direction.

3. The retainer claimed in claim 1, wherein the pair of connection arms are formed of sheet metal.

4. The retainer claimed in claim 1, wherein the pair of connection arms are integrally formed in one piece.

5. The retainer claimed in claim 1, wherein a distal end of each of the projecting portions of each connection arm includes a hook portion, and wherein the hook portion engages a stopper of each corresponding slide groove thereby preventing the connection arm from deviating from the slide groove.

6. The retainer claimed in claim 1, wherein said bottoms of said slide grooves, against which said slopes of said connection arms can be abutted to expand the entrance to the introduction space, are disposed perpendicular to a surface of said housing with which said connection arms are slidably engageable.

7. The retainer claimed in claim 1, wherein said insertion projection extends from said main body in parallel with said projecting portion of said connection arms, is slidably insertable into an end of an insertion void together with and in the same direction as a tip end of said flat cable, and comprises a pressing portion that presses said tip end of said flat cable in contact with said plurality of contacts in said insertion space.

8. The retainer claimed in claim 1, wherein the projecting portions of each connection arm each include a lock section for locking each corresponding connection arm to the housing when the insertable projection inserted in the insertion space is pressing the end of the flat cable into contact with the plural contacts.

9. The retainer claimed in claim 8, wherein the lock section resiliently engages a corresponding portion of the housing.

10. An electrical connector for removably connecting a flat cable at its end comprising:

a housing defining an insertion space for insertion of the flat cable, and a retainer for pressing the end of the flat cable inserted in the insertion space into contact with a plurality of contacts in the insertion space, wherein the retainer includes, a main body formed of a synthetic resin and including an elongate body section and an insertable portion extended from the body section for insertion into the insertion space, and a pair of connection arms made of metal and fixed to the main body, and also connectable to the housing by being slidable along the housing in a predetermined direction, each connection arm including, a buried portion that is buried in the body section during molding of the main body, and a projecting portion projecting from the body section along a predetermined position, a distal end of each projecting portion having a slope that is inclined with respect to the predetermined direction, wherein the connection arms are slidably insertable into corresponding slide grooves of the housing in the predetermined direction, and slidable along the slide grooves for guiding the insertable projection in its insertion into or removal from the insertion space, and the connection arms are inclinable to bring the respective slopes thereof into abutment against bottoms of the corresponding slide grooves, thereby relatively expanding, in the insertion space, an entrance to an introduction space for the flat cable.

11. The electrical connector claimed in claim 10, wherein the projecting portion of each connection arm includes a hook portion, wherein each slide groove is provided with a stopper, and wherein the hook portions of the projecting portions engage with the corresponding stoppers, thereby preventing the connection arms from deviating from the corresponding slide grooves.

12. The electrical connector claimed in claim 10, wherein said bottoms of said slide grooves, against which said slopes of said connection arms can be abutted to expand the entrance to the introduction space, are disposed perpendicular to a surface of said housing with which said connection arms are slidably engageable.

13. The electrical connector claimed in claim 10, wherein said insertion projection extends from said main body in parallel with said projecting portion of said connection arms, is slidably insertable into an end of an insertion void together with and in the same direction as a tip end of said flat cable, and comprises a pressing portion that presses said tip end of said flat cable in contact with said plurality of contacts in said insertion space.

14. The electrical connector claimed in claim 10, wherein the slide grooves slidably receive the respective projecting portions of the connection arms, and the housing includes respective pairs of side walls corresponding to the respective slide grooves, and wherein each pair of side walls prevent each corresponding projecting portion inserted in each slide groove from exposing itself to each lateral side of the housing.

15. The electrical connector claimed in claim 14, wherein the projecting portion of each connection arm includes a lock section, wherein each slide groove is provided with an engagement portion to engage with the lock section of each corresponding projecting portion, and wherein each lock section locks each corresponding connection arm to the housing when the insertable projection is pressing the end of the flat cable into contact with the plural contacts.

16. A retainer for an electrical connector for establishing pressure contact between an end of a flat cable inserted in an insertion space of a housing of the connector and a plurality of contacts in the insertion space comprising:

a pair of connection arms fixed to a main body, and also slidingly connectable to the housing in a predetermined direction, each connection arm including a sloped distal end that is inclined with respect to the predetermined direction, wherein the connection arms are slidably insertable into corresponding slide grooves of the housing in the predetermined direction, and also are inclinable to bring the sloped distal ends into abutment against bottom surfaces of the corresponding slide grooves, thereby relatively expanding, in the insertion space, an entrance to an introduction space for the flat cable.

17. An electrical connector for removably connecting a flat cable at its end comprising:

a housing defining an insertion space for insertion of the flat cable, and a retainer, for pressing the end of the flat cable inserted in the insertion space into contact with a plurality of contacts in the insertion space, comprising a pair of connection arms fixed to a main body, and also slidingly connectable to the housing in a predetermined direction, each connection arm including a sloped distal end that is inclined with respect to the predetermined direction, wherein the connection arms are slidably insertable into corresponding slide grooves of the housing in the predetermined direction, and also are inclinable to bring the sloped distal ends into abutment against bottom surfaces of the corresponding slide grooves, thereby relatively expanding, in the insertion space, an entrance to an introduction space for the flat cable.

* * * * *